US005403001A

United States Patent [19]

Skorpinski

[11] Patent Number: 5,403,001

[45] Date of Patent: Apr. 4, 1995

[54] GOLF PUTTING AID DEVICE AND CHART

[76] Inventor: Frank J. Skorpinski, 6565 W. Torino, Las Vegas, Nev. 89139

[21] Appl. No.: 247,281

[22] Filed: May 23, 1994

[51] Int. Cl.[6] ..... A63B 57/00; A63B 69/36

[52] U.S. Cl. ..... 273/32 H; 33/379; 33/389; 273/162 B

[58] Field of Search ..... 273/35, 32 H, 162 B; 33/379, 389

[56] References Cited

U.S. PATENT DOCUMENTS

| | | | |
|---|---|---|---|
| 3,138,878 | 6/1964 | Mehlman | 33/379 |
| 3,751,819 | 8/1973 | Dixon | 33/389 |
| 4,082,286 | 4/1978 | La Breche | 273/162 B |
| 4,993,710 | 2/1991 | Marshall | 273/32 H |
| 5,209,470 | 5/1993 | Cimaroli et al. | 273/32 H |
| 5,330,179 | 7/1994 | Hampel | 273/32 H |

FOREIGN PATENT DOCUMENTS

| | | | |
|---|---|---|---|
| 1060973 | 11/1953 | France | 33/389 |

*Primary Examiner*—William H. Grieb

*Attorney, Agent, or Firm*—Rhoads, Coats & Bennett

[57] ABSTRACT

A putting aid device for aiding a golfer in reading a putting green by measuring the direction and amount of slope in a green and indicating to the golfer a putting variance factor for a particular ball lie relative to a ball hole. The putting variance factor produced by the putting aid device corresponds to the distance from a reference putting line to an off-set target point. The putting aid device includes an elongated housing, an elongated bubble vial, and a putting variance scale calibrated with respect to the bubble vial. In use, the putting aid device is selectively positioned on a reference putting line and indicates an off-set target distance. The putting aid device can be used to produce a putting variance chart of the conditions of a green.

5 Claims, 4 Drawing Sheets

GOLF PUTTING AID DEVICE AND CHART

BACKGROUND OF THE INVENTION

A golfer's ability to putt has a substantial impact on the golfer's overall game and handicap. In order to effectively putt, a golfer must be able to effectively estimate the direction and the amount that the ball will break as the ball moves toward the golf hole. Based on this estimate, a golfer locates on the green an imaginary, off-set target point. The off-set target point is displaced a certain distance from a straight reference putting line extending from the ball to the hole. The off-set target point is calculated such that a ball putted toward the off-set target point will follow a curved path leading over the golf hole.

The slope of the area of the green between the ball and hole is one of the primary factors affecting how the ball will break when it is putted. Accordingly, a golfer must be able to accurately determine the direction in which a green slopes and the degree to which the green slopes in order to putt effectively. This is often referred to as "reading" a green. Many golfers have difficulty in reading a green. In fact, many golfers must play a golf course numerous times before they can accurately estimate how a golf ball will break when putted on the course's putting greens.

A device and method is needed to aid a golfer in reading a green to determine the direction and amount that a golf ball will break as it travels to the golf hole.

SUMMARY AND OBJECTS OF THE INVENTION

The present invention entails a putting aid device for aiding a golfer in reading a putting green by measuring the direction and amount of slope in a green and indicating to the golfer a putting variance factor for a particular lie relative to the hole. A golfer uses the putting variance factor to determine where an off-set target point should be located on the green with respect to a straight, reference putting line that extends between the ball and the hole. By using the putting aid device, the location of the off-set target point can be more effectively calculated such that a ball putted toward the off-set target point will follow a curved path leading over the golf hole.

The putting aid device includes an elongated housing and an elongated bubble vial mounted in the housing. The bubble vial is partially filled with a fluid and has a moveable bubble that moves longitudinally within the vial with changes in orientation of the housing.

Located adjacent the bubble vial and along the housing is a putting variance scale. The putting variance scale is formed adjacent the bubble vial for indicating to a golfer a certain putting variance factor for a given ball lie. The putting variance scale includes a zero reference mark (inscribed wider for easy identification), and a series of spaced-apart reference marks disposed on each side thereof. As the orientation of the housing is altered, the bubble in the bubble vial moves adjacent one or more reference marks to indicate a putting variance factor. By selectively placing the putting aid device on the green, the putting aid device achieves an orientation corresponding to the slope of the area of the green over which the ball must travel. In particular, the bubble moves longitudinally along the putting variance scale to one side of a zero reference mark and indicates a putting variance factor and a putting variance direction used in determining-the amount that the golf ball will break.

The putting aid device can be used prior to putting each shot or can be used to map a green. Mapping a green with the putting aid device involves measuring a putting variance factor and direction with the putting aid device at selected points along a circle encircling the golf hole and inscribing a green chart with this information. Once the putting green has been mapped, a golfer can refer to the green chart prior to each shot to determine where the off-set target point should be located to compensate for the sloping green. Use of the green chart eliminates the need to use the putting aid device immediately prior to each putt.

Accordingly, it is an object of the present invention to provide a putting aid device for use by a golfer in determining the amount of break and direction of break for a particular lie.

Another object of the present invention is to provide a putting aid device that is easy to use.

Another object of the present invention is to provide a putting aid device that produces a reference off-set target point distance.

Another object of the present invention is to provide a putting aid device for use by a golfer in determining whether there is a downward slope or an upward slope in the area of the green between a golf ball and golf hole.

Another object of the present invention is to provide a putting aid device for use in producing a putting variance chart that maps putting conditions for a golf green.

Other objects and advantages of the present invention will become apparent and obvious from a study of the following description and the accompanying drawings which are merely illustrative of such invention.

DETAILED DESCRIPTION OF THE INVENTION

Figure 1:
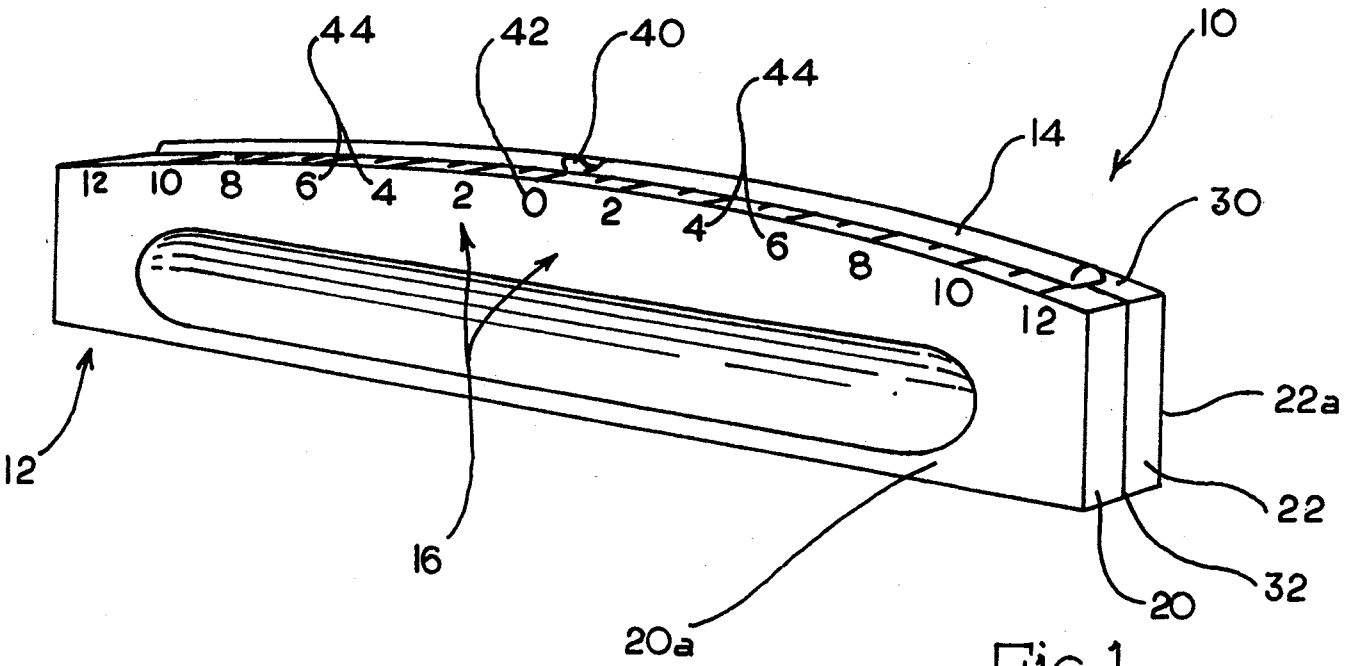
FIG. 1 is a perspective view of the putting aid device of the present invention.

With reference to the drawings, the putting aid device of the present invention is shown therein and indicated generally by the numeral 10. Putting aid device 10 generally includes an elongated housing 12, an elongated bubble vial 14 mounted in housing 12, and a putting variance scale 16 displayed on both sides of the housing 12. As will be described below, putting aid device 10 is used by a golfer to assist in accurately putting a golf ball having a particular lie on the green.

Housing 12 includes a first elongated mating section 20 and a second elongated mating section 22. The elongated mating sections 20 and 22 are secured together to form an elongated housing 12. Elongated housing 12 has opposed faces 20*a* and 22*a*, an arcuate top edge 30, and a flat bottom edge 32. Bottom edge 32 is flat to allow housing 12 to be placed on the ground or other flat surface in an upright position with first and second faces 20*a* and 22*a* in a generally vertical position.

Mounted in a top section of housing 12 and extending longitudinally along housing 12 is the bubble vial 14. Bubble vial 14 is mounted in housing 12 such that it is viewable by a golfer standing on either side of putting aid device 10. As shown in FIG. 1, bubble vial 14 extends above top edge 30 of housing 12. In an alternative embodiment, bubble vial 14 is mounted in housing 12 such that it is disposed below top edge 30 of housing 12. Mounting bubble vial 14 below top edge 14 provides additional protection for bubble vial 14. Although bubble vial 14 is mounted below top edge 30 in this alternative embodiment, a golfer standing would be viewing bubble vial 14 from above and would be able to view bubble vial 14 from either side of putting aid device 10.

In the preferred embodiment, bubble vial 14 has an arcuate shape conforming to top edge 30 of housing 12 and is constructed from a clear, Pyrex tube. The bubble vial 14 is partially filled with a methanol fluid combined with a colored dye such that an easily viewable bubble 40 is formed in the bubble vial 14. Bubble 40 moves longitudinally along the bubble vial 14 as the orientation of the housing 12 is varied.

Figure 2:
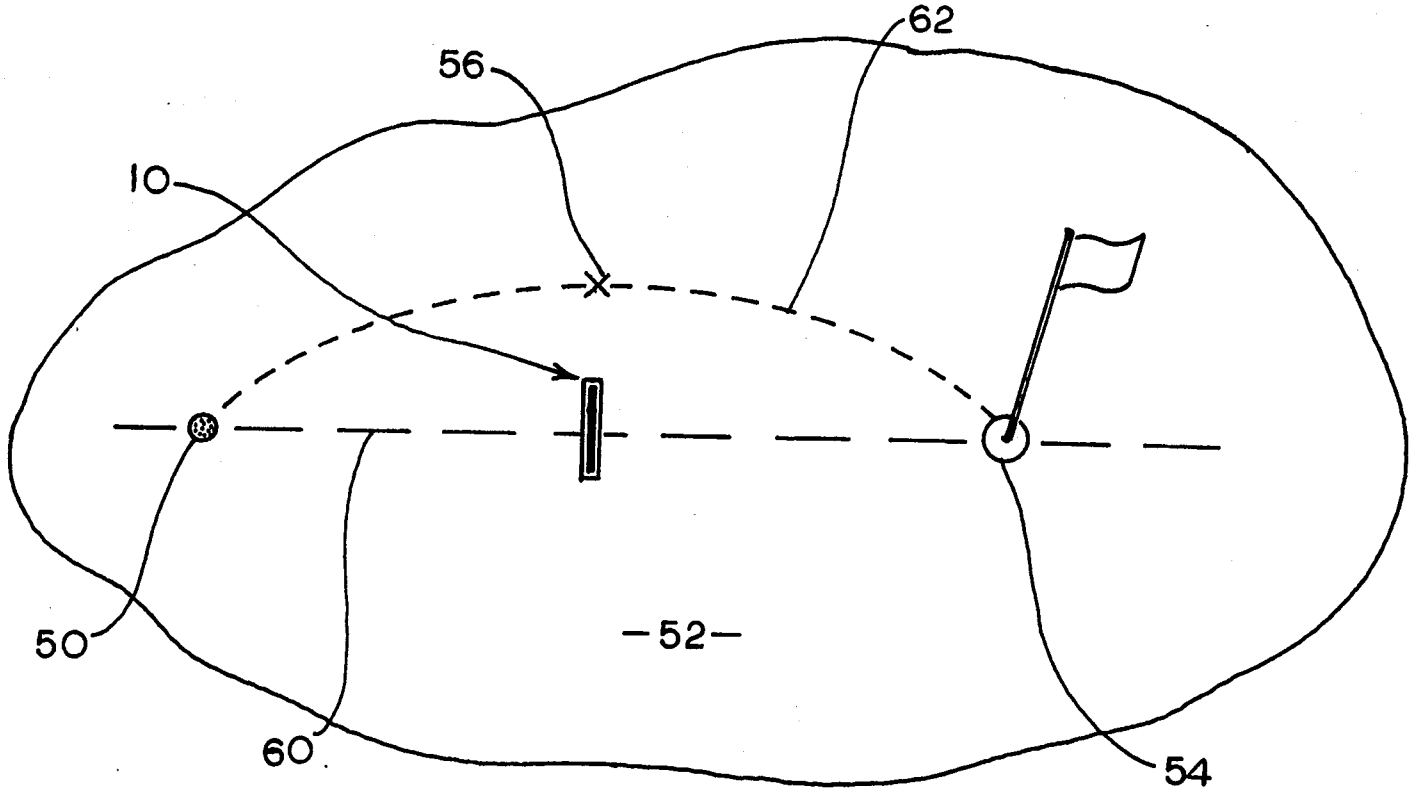
FIG. 2 is a schematic view of the putting aid device being used on a green.
Figure 2A:
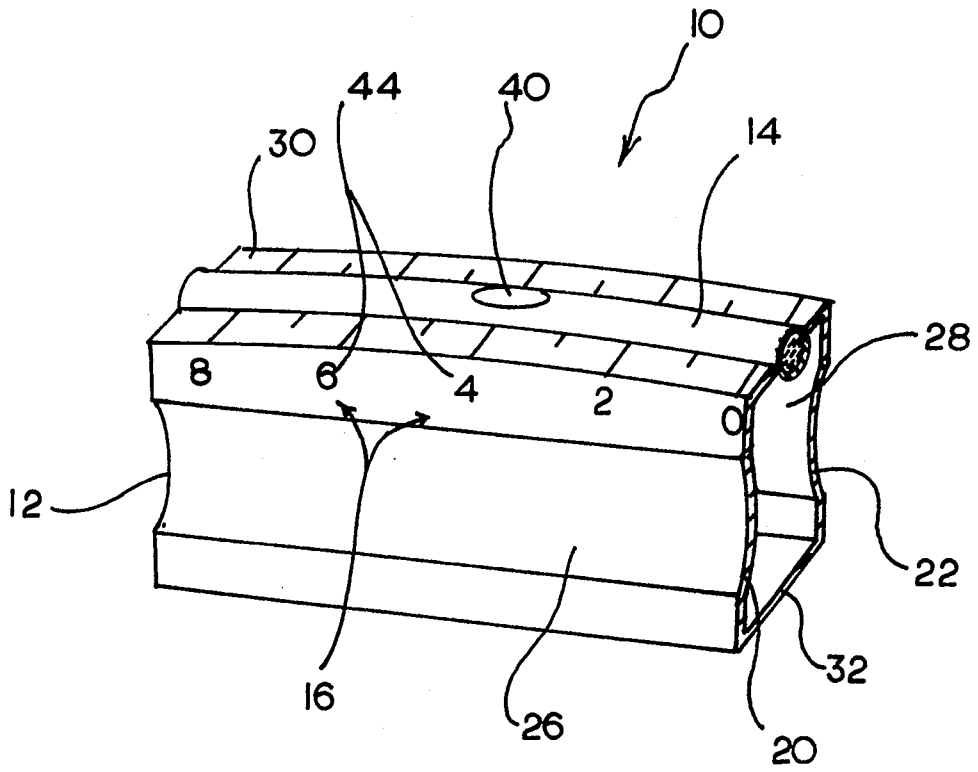
FIG. 2*a* is a fragmentary perspective view of the golf putting aid of the present invention showing the bubble indicating a putting variance factor of four.

Located adjacent bubble vial 14 is the putting variance scale 16. As shown in FIG. 2*a*, the putting variance scale 16 extends along each face 20*a* and 22*a* of housing 12. Putting variance scale 16 includes a neutral or zero reference mark 42 and putting variance reference marks 44 disposed on each side of the zero reference mark 42. The reference marks 42 and 44 extend along the length of housing 12. As the orientation of housing 12 is varied, bubble 40 of vial 14 is moved adjacent to and marks one or more reference marks 42 and 44.

As will be appreciated from subsequent portions of this disclosure. The golf putting aid 10 of the present invention has to be calibrated for a certain reference putting distance. In the case of the example illustrated herein, the putting aid device is calibrated for a standard or reference 5 foot putt and the indica marks 42 and 44 formed on the putting aid device represents "inches" That is, the putting variance factor that is indicated by the bubble on the putting aid device is in inches and represents a putting variance factor for a 5 foot putt. It is important to realize that the putting variance factor represented by the putting aid device means a reference off-set distance from a straight or reference line extending between the ball and the hole. Also, it is important to appreciate that the putting variance factor represents an off-set distance from the mid point of the reference putting line. For example, consider a situation where the ball lies exactly 5 feet from the hole and the putting aid device is placed midway between the ball and the hole and indicates "four". This means that the putting variance factor is four inches to the high side of the straight line reference putting line since one is dealing with a standard or reference 5 foot putt. This means that the target point for putting the ball will be four inches to the high side of the reference putting line displaced from the mid point between the ball and the hole.

Therefore, the putting aid of the present device is designed around first determining the direction of slope of the green that lies between the ball and the hole. Next, a reference off-set is determined and that off-set is in the form of a distance off-set in inches. Then that off-set distance is corrected for the actual putting distance between the lie of the ball and the hole.

The putting aid device 10 is used to aid a golfer in putting as follows. With reference to FIG. 2, a golfer initially strikes a golf ball 50 onto a golf green 52. Golf ball 50 comes to rest on green 52 and is located a certain distance from golf hole 54.

If the area of the green 52 between the ball 50 and hole 54 (the "putting area") were flat, the golfer could effectively putt ball 50 along a straight, reference putting line 60 which extends from ball 50 to hole 54. However, in this example, golf ball 50 lies on a putting area that is not flat. As will often be the case, ball 50 lies on a putting area of green 52 where there is a slope between the ball 50 and hole 54 that is transverse to the reference putting line 60. A transverse slope between ball 50 and hole 54 will cause the ball to break and not travel in a straight line when putted.

When putting a golf ball lying on a transverse slope, a golfer typically putts towards a selected off-set target point 56 that is spaced a selected distance from the reference putting line 60. The distance at which the off-set target point 56 is spaced from reference putting line 60 will be referred to as the off-set target distance.

The off-set target point 56 can be spaced from the reference putting line 60 at different locations along reference putting line 60. Many golfers space the off-set target point from a point on the reference putting line 60 located midway between the ball 50 and hole 54. Other golfers typically choose to locate the off-set target point 56 a selected distance from the hole 54. In the example shown in FIG. 2 and described below, the golfer selects an off-set target point 56 spaced a selected distance from a point on the reference putting line 60 located midway between ball 50 and hole 54.

The distance of the off-set target point for a given ball lie depends primarily on two factors: (1) the putting distance; and (2) the amount of transverse slope in the area of the green between ball 50 and hole 54. In particular, as the putting distance increases, the amount a golf ball 50 will break as it travels toward the hole increases. Likewise, as the green slope increases, the amount of "break" increases. Accordingly, the off-set target distance increases as the green slope increases and as the putting distance increases. The putting aid device 10 of the present invention is used to determine where the off-set target point 56 should be located to improve the golfer's likelihood of successfully putting ball 50. To use putting aid 10, a golfer places putting aid 10 on the reference putting line 60 at a location approximately midway between ball 50 and hole 54. Putting aid device 10, however, can be place anywhere along the reference putting line 60 that represents the slope of the area of the green between ball 50 and hole 54. Accordingly, putting aid device 10 could be located behind ball 50 or past hole 54 on the reference putting line 60. In fact, the putting aid 10 can be placed anywhere on the green 52 where the slope generally corresponds to the slope between the ball 50 and the hole 54.

The bottom edge 32 of housing 12 is placed on the ground such that putting aid device 10 assumes an upright position with first and second faces 20*a* and 20*b* in a generally perpendicular position with respect to the underlying green 52. Putting aid device 10 is positioned in a perpendicular position with respect to the reference putting line 60 with the zero reference mark 42 of putting variance scale 38 disposed directly over the reference putting line 60. In this position, putting aid device 10 will assume an orientation that corresponds to the transverse slope of the area of the golf green between the golf ball 50 and ball hole 54.

In the example shown in FIG. 2, ball 50 lies approximately five feet from golf hole 54 and lies on an area of green 52 that has a single transverse slope extending between ball 50 and hole 54. When the putting aid device 10 is positioned midway between ball 50 and hole 54 (approximately two and one-half feet from hole 54), housing 12 of putting aid device 10 assumes a tilted orientation corresponding to the slope of the putting area.

A tilted orientation of housing 12 causes bubble 40 to move along bubble vial 14 and be positioned on one side of zero reference mark 42 and on one side of the reference putting line 60. When the putting aid device 10 is tilted in one direction, bubble 40 marks one or more reference marks on a first side of the zero reference mark 42. When the putting aid device 10 is tilted in an opposite direction, bubble 40 marks one or more reference marks on an opposite, second side of the zero reference mark 42.

A golfer knows which side of reference putting line 60 to locate the off-set target point 56 by observing the location of bubble 40 on putting variance scale 16 with respect to the zero reference mark 42 and the reference putting line 60. The side of the variance scale 16 that is marked by bubble 40 indicates which side the off-set target point 56 is located. The off-set target point 56 and the side of the hole that ball 50 will be putted is on the same side of the reference putting line 60 that bubble 40 is located. In the example shown in FIG. 2, the bubble 40 would move to the side of the variance scale 16 positioned between the reference putting line 60 and off-set target point 56.

Putting aid device 10 also is used to determine the distance that off-set target point 56 should be located from reference putting line 60 for various putting lengths. In particular, the reference marks of the putting variance scale 16 identified by bubble 40 indicates the reference putting variance factor or reference off-set target distance for a reference putting length. The reference putting variance factor produced by putting aid device 10 is calibrated for a five foot putt and for an off-set target point 56 that is spaced from a point on the reference putting line 60 that is located midway between ball 50 and green 52.

In the example shown in FIGS. 2 and 2A, the putting aid device 10 produces a putting variance factor of four. The putting variance scale 16 is calibrated in inches and thus a reading of "four" indicates an off-set of four inches. Because the actual putting distance in the present example equals the reference putting distance (5 feet) of the putting aid device 10, the off-set target distance is four inches. Accordingly, off-set target point 56 is located four inches from a point located on reference putting line 60 and located approximately two and one-half feet from hole 54. A ball putted towards target point 56 will follow an adjusted putting path 62 calculated to lead ball 50 over golf hole 54. See FIG. 2.

The off-set target point 56 for balls located at putting distances other than the reference putting distance can also be calculated with putting aid device 10. When the ball 50 is located at a distance different from the reference putting distance, the reference putting variance factor produced by putting aid device 10 must be multiplied by a correction factor.

The correction factor is equal to the ratio of the actual putting distance divided by the reference putting distance. For example, the actual putting variance factor or off-set target distance for a ten-foot putt would be determined as follows. First, putting aid device 10 would be positioned midway between hole 54 and ball 52 on reference putting line 60, as discussed previously. The golfer would then read the reference putting variance factor produced by putting aid device 10. If the ball was located on a transverse slope that was identical to the putting area slope of the initial example, the putting aid device 10 would produce a reference putting variance factor of "four".

Because the total amount a ball breaks increases as the putting distance increases, the reference putting variance factor produced for the ten foot putt must be corrected. The reference putting variance factor is multiplied by a correction factor. The correction factor, in this example, would be ten feet (actual putting distance) divided by five feet (reference putting distance) to produce a correction factor of two. The correction factor of two would then be multiplied by the reference off-set target distance of four to arrive at an actual off-set target distance of eight inches.

A golfer can also use putting aid device 10 to determine whether the area of the green between ball 50 and hole 54 slopes downhill or uphill. To determine whether there is a downhill or uphill slope, the golfer places putting aid device 10 in an upright position on reference putting line 60 such that putting aid device 10 extends along and is parallel with reference putting line 60. Putting aid device 10 is preferably located approximately half way between ball 50 and hole 54.

When putting aid device 10 is placed parallel with reference putting line 60, bubble 40 will move to a location on the putting variance scale 16 that indicates whether there is an downhill or uphill slope. If there were an uphill slope, bubble 40 would move to a side of the zero reference mark 42 closest to hole 54. If there was a downhill slope in the green extending between ball 50 and hole 54, bubble 40 would move to a side of the zero reference mark 42 closest to ball 50.

The amount or degree of downhill or uphill slope can also be estimated by putting aid device 10. A steeper slope would cause bubble 40 to move further from the zero reference mark 42 to produce a higher putting variance factor. The golfer could estimate the steepness of the putting green based on the putting variance factor produced by the putting aid device 10.

The example and use of putting aid device 10 described above involved a single transverse slope extending between ball 50 and hole 54. A golfer could likewise use the putting aid device 10 when there are two or more different slopes between a ball 50 and hole 54. For example, putting aid device 10 could be used to calculate how much a ball would break as it travels over each individual slope. The amount of break for each slope can be added or subtracted with one another to determine the overall direction and amount of break that a ball 50 will experience as it travels to hole 54. Based on this information, a golfer could more accurately locate an off-set target point 56 for a green 52 having multiple slopes.

Putting aid device 10 can also be used to select an off-set target point 56 that is not located midway between ball 50 and hole 54. Some golfers prefer to select an off-set target point that is spaced a selected off-set distance from hole 54. An off-set target point 54 located in this manner is calculated such that a putted ball will follow a ball path leading over the hole 54 when the ball is putted directly at the off-set target point. A golfer wanting to locate the off-set target adjacent to and spaced from the hole 54 uses the putting aid device 10 as discussed above to determine the reference putting variance factor for a particular ball lie. However, the reference putting variance factor must be multiplied by a correction factor due to the change in location of the off-set target point 56 along the reference putting line 60. In the example of FIG. 2, the correction factor for an off-set target point 56 spaced from hole 54 is two. The off-set target point correction factor of 2 is arrived at as follows: the reference putting length is five feet and the reference off-set target point is measured midway the reference putting length which is at 2.5 feet. In this case, we are attempting to locate an off-set target point adjacent the hole which is in reality 5 feet from the ball. Therefore, to obtain the correction factor for the off-set target point we divide the putting distance (5 feet) by 2.5 feet (the point on the reference putting line where the reference off-set target point is projected from). Therefore, assume that for the standard five foot putt shown in FIG. 2, that the putting aid device produces a putting variance factor of four. Now, assume the golfer wants to establish the off-set target point 56 adjacent the hole of 54. To accomplish this, the off-set target correction factor 2 is multiplied by four to yield an 8 inch off-set adjacent the hole 54. Accordingly, the golfer would aim the ball 50 at an imaginary target point spaced 8 inches off-set to the appropriate side from the hole 54. One must realize that this off-set target point adjacent the hole is calculated for a standard 5 foot putt. If the putting distance is longer than 5 foot, then the putt has to be corrected for distance, as explained above.

Figure 3:
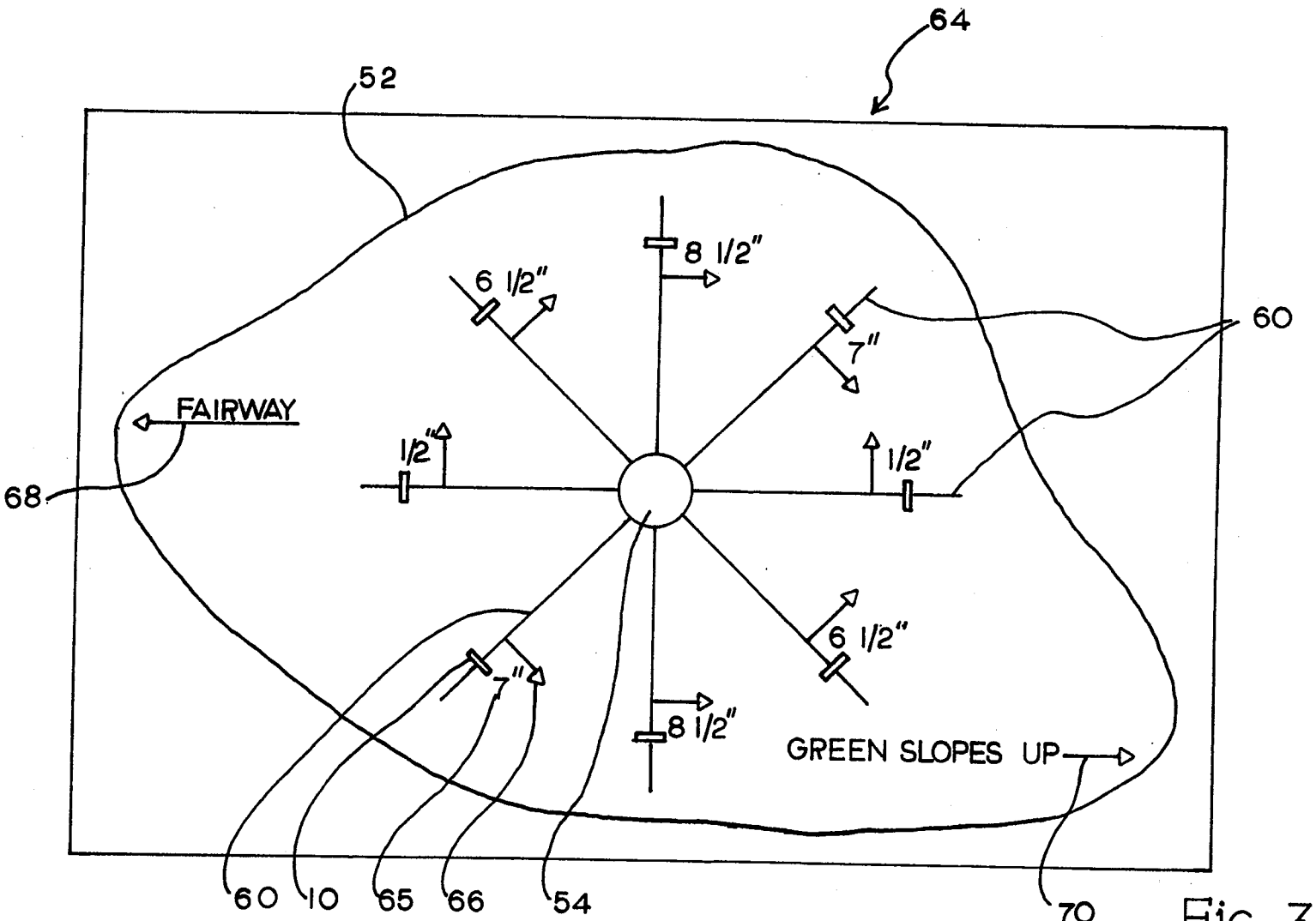
FIG. 3 is a schematic view of a putting variance chart produced through the use of the putting aid device of the present invention.

A golfer can also use putting aid device 10 to produce a putting variance chart 64, as shown in FIG. 3. Putting chart 64 includes a plurality of reference putting variance factor indicia 65 at selected locations on a green 52. A golfer can easily refer to putting variance chart 64 prior to a putt for aid in selecting an off-set putting target point. The use of putting variance chart 64 eliminates the need of a golfer to use putting aid device 10 before each individual putt.

Putting variance chart 64 pictorially depicts a green 52 with a ball hole 54. Extending from ball hole 54 are a plurality of reference putting lines 60. The reference putting lines 60 are circumferentially spaced (at forty-five degree increments, for example) around ball hole 54. The angle of the spacing could vary and could for example be spaced at thirty degrees, fifteen degrees, etc.

Depicted on each reference putting line 60 is a putting aid device 10 located in a perpendicular position with respect to reference putting line 60. The direction of the off-set target point for a ball located along each reference putting line 60 is depicted by an off-set direction arrow 66. The putting variance factor (referred to by numeral 65 in FIG. 3) chosen represents the putting variance factor for a five foot putt having an off-set target point spaced from a point on reference putting line 60 located midway between ball site and hole 54.

Putting variance chart 64 further depicts a fairway direction arrow 68 and a general green slope arrow 70 for aiding the golfer in using putting variance chart 64.

A golfer uses putting aid device 10, as discussed previously, to produce putting variance chart 64 described above and shown in FIG. 3. Chart 64 enables a golfer to obtain the benefits of putting aid device 10 without having to use the device 10 prior to each putt. This is important because current golfing regulations do not permit the use of putting aid device 10 during tournament play. However, a golfer could get many of the benefits of putting aid device 10 by producing putting variance chart 64 prior to a golf tournament. During the golf tournament, the golfer could refer to putting variance chart 64 prior to each putt to aid the golfer in correctly locating an off-set target point midway between the golf ball and golf hole (approximately $2\frac{1}{2}$ feet in the present example).

Putting aid device 10 provides for an effective apparatus and method for improving a golfer's putting game by aiding a golfer in reading the greens. The elongated bubble vial 14 is calibrated with respect to the putting variance scale 16 to produce a putting variance factor or off-set target point distance for a selected putting distance. Accordingly, a golfer can quickly and accurately determine the location of the off-set target point 56 for a particular ball site.

Embodiments of putting aid device 10 could also be used that include a digital read-out of the distance and direction of the off-set target point.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A method of using a level-type golf putting aid to produce a putting variance chart, comprising the steps of:

(a) calibrating the level-type golf putting aid such that a bubble incorporated therein aligns with various reference marks along the golf putting aid as the golf putting aid is tilted, and wherein the alignment of the bubble with a particular reference mark indicates a putting variance factor for a reference putting distance that correlates to a reference off-set target distance extending from a reference putting line;

(b) placing the level-type golf putting aid at a plurality of green sites which correspond to individual ball sites, and wherein each green site represents the general slope of the green between one of the ball sites and a golf hole;

(c) producing a putting variance factor with the golf putting aid for each ball site;

(d) determining slope direction with the golf putting aid for each ball site, and determining for each ball site a direction of a reference off-set target point with respect to a reference putting line extending between the ball site and the golf hole;

(e) determining for each ball site the distance of an off-set target point, wherein the distance of each off-set target point corresponds with one of the produced putting variance factors;

(f) inscribing on the putting variance chart at selected sites the distance of each off-set target point for that site; and (g) inscribing on the putting variance chart at selected sites a slope direction indicator corresponding to the slope direction for each site.

2. The method of claim 1 wherein the step of placing the level-type putting aid at a plurality of green sites includes placing the level-type putting aid at a plurality of sites that encircle the golf hole.

3. The method of claim 2 wherein the ball sites are each spaced a selected number of degrees apart from one another.

4. The method of claim 3 wherein the selected number of degrees is approximately 45.

5. The method of claim 2 wherein all the ball sites are located a reference putting distance from the golf hole.

* * * * *